United States Patent [19]

Abe et al.

[11] 4,233,582

[45] Nov. 11, 1980

[54] DEFLECTION YOKE FOR USE WITH WIDE ANGLE DEFLECTION SYSTEM

[75] Inventors: Masayuki Abe, Yokohama; Yuji Fujihira, Fujisawa, both of Japan

[73] Assignee: Hitachi, Ltd., Japan

[21] Appl. No.: 910,345

[22] Filed: May 30, 1978

[30] Foreign Application Priority Data

Aug. 24, 1977 [JP] Japan ..... 52-101432

[51] Int. Cl.[3] ..... H01F 5/00

[52] U.S. Cl. ..... 335/213; 335/210

[58] Field of Search ..... 335/210, 213, 212

[56] References Cited

U.S. PATENT DOCUMENTS

| | | | |
|---|---|---|---|
| 2,824,267 | 2/1958 | Barkow | 335/213 |
| 3,912,182 | 10/1975 | Ishikawa | 335/210 X |

*Primary Examiner*—George Harris

*Attorney, Agent, or Firm*—Craig & Antonelli

[57] ABSTRACT

A yoke adapted for use with a wide deflection angle picture tube used in a television receiver set is disclosed, in which a horizontal yoke is of saddle-shape and a fringe thereof is of non-circular shape so that a raster scanned on the picture tube shows no vertical pincushion distortion.

14 Claims, 6 Drawing Figures

DEFLECTION YOKE FOR USE WITH WIDE ANGLE DEFLECTION SYSTEM

The present invention relates to a deflection yoke for use with a picture tube of a television receiver set and more particularly to deflection yoke for wide deflection angle picture tube in which vertical raster distortion is not produced.

In a conventional television receiver set, a raster is formed by an electron beam which is scanned on a face plate of the picture tube and the raster includes much distortion. For example, when a radius of curvature of the face plate is smaller than a deflection angle of a deflection yoke and a deflection magnetic field is uniform, the scanned raster has a pincushion distortion. A conventional deflection yoke having a pair of saddle-shaped horizontal deflection yoke coils produces pincushion-shaped horizontal deflection field at an exit of the electron beam so that a vertical pincushion distortion of the raster is reduced. However, the saddle-shaped horizontal deflection coil has a circular fringe so that a current flowing in the fringe also produces a magnetic field. Probably because of this magnetic field, the conventional deflection yoke cannot fully reduce the vertical pincushion distortion and there still remains wing-shaped secondary harmonics distortions of the vertical pincushion distortion at the left and right ends and the center of the raster. When the pincushion-shaped horizontal deflection field is stronger, the distortion at the center of the raster disappear but the distortion at the opposite ends of the raster further increases. Consequently, the prior art television receive set is further equipped with a compensation circuit or permanent magnets for compensating for the pincushion distortion or the secondary harmonics distortion.

It is an object of the present invention to provide a deflection yoke which does not produce a vertical pincushion distortion of a raster.

The deflection yoke of the present invention is provided with a pair of improved horizontal deflection yoke coils having deformed fringes on the side of a face plate or an exit of an electron beam. The fringes are so formed that a distance between a center of the fringe and a center axis of the deflection yoke is smaller than that between any portion other than the center of the fringe and the center axis. That is to say, the fringes on the side near the face plate of the horizontal deflection coils are arched and are formed in an oval shape in overall, and linear at the center of the fringe or the most preferably concave at the center of the fringe. The shape of the fringe defined above not only represents a contour thereof but also represents a shape of current path.

When a magnetic field produced by a current flowing in the fringe is increased or decreased, or the shape of the magnetic field is changed, the secondary harmonics distortion may be reduced. In the present invention, the magnetic field produced by the fringe is enhanced at an area through which the electron beam passes, and this magnetic field is positively utilized.

When the center portion of the fringe is shaped to be concave or linear or the entire fringe is oval, the center portion of the fringe is closer to the area through which the electron beam passes. Therefore, the magnetic field produced by the current flowing in the fringe is more intensified at the electron beam passing area than the magnetic field produced by the current flowing in the conventional circular fringe. The magnetic field produced by the current flowing in the deformed fringe has a field component which is normal to the face plate, which field component functions to suppress the vertical deflection of the horizontally deflected beam. Consequently the amount of vertical deflection of the horizontally deflected electron beam reduces and hence the distortion is reduced. Furthermore, since the magnetic field produced by the fringe is intensified only near the fringe, this magnetic field strongly acts on the largely vertically deflected electron beam, that is, the electron beam which produces the distorted raster.

These and other objects, features and advantages of the present invention will be apparent from the following description of the preferred embodiment of the invention when taken in conjunction with the accompanying drawings, in which.

Figure 1:
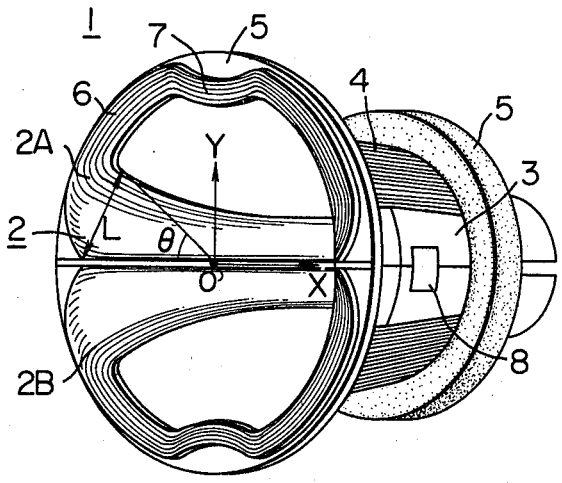
FIG. 1 is a perspective view of one embodiment of a deflection yoke of the present invention.
Figure 2:
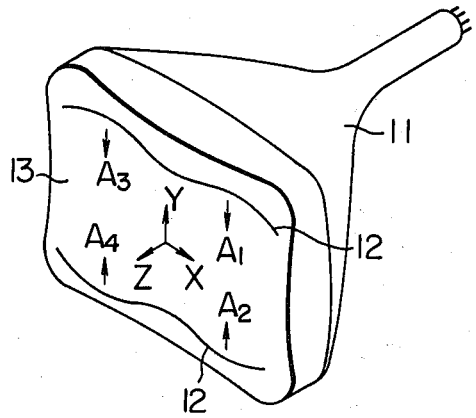
FIG. 2 shows distortion of a raster on a face plate.

The preferred embodiments of the invention will now be explained in detail. In FIG. 1, a deflection yoke 1 of the present invention comprises a horizontal deflection coil 2, a cylindrical core 3 of which the bore on the side of the face plate is larger than that on the side near the neck of the picture tube, a vertical deflection coil 4 wound in a toroidal pattern on the core 3, and a separator 5. The core 3 is of cylindrical shape with two semi-cylindrical cores being coupled together by a core clamp 8. The horizontal deflection coil 2 comprises two saddle-shaped coils 2A and 2B each having a fringe 6, 6' which projects in the radial direction over the core. The coils 2A and 2B are arranged to extend into the core 3. The separator 5 is disposed between the vertical deflection coil 4 and the horizontal deflection coil 2, and it maintains insulation between the vertical deflection coil 4 and the horizontal deflection coil 2. The deflection coil 2 of the deflection yoke 1 has a small width L and produces a pincushion-shaped deflection field at an exit of an electron beam. The pincushion-shaped deflection field is intensified extremely when an angle $\theta$ is equal to 30°, where the angle $\theta$ is defined as an angle made by a line connecting the end of the horizontal deflection coil 2 and a center O and an X-axis. A conventional horizontal deflection coil 2 which produces the pincushion-shaped magnetic field has the angle $\theta$ which is approximately equal to 45°. The horizontal deflection coil 2 of the present invention has a fringe 6 having its center portion 7 concaved. A secondary harmonics distortion of a raster 12 scanned on a face plate 13 of a picture tube 11 shown in FIG. 2 is eliminated by a magnetic field produced by the center portion 7 of the fringe 6. In order for the distortion of the raster 12 to be eliminated, the raster 12 must be moved in the directions shown by arrows $A_1$, $A_2$, $A_3$ and $A_4$ while the center portion of the raster 12 should not be moved. The function of the center portion 7 of the fringe 6 is now explained. In order to facilitate the understanding of the present invention, a center axis of the deflection yoke 1 is defined as a Z-axis, and X-axis and Y-axis are defined as shown in FIG. 1. Similarly, the X-axis, Y-axis and Z-axis of the picture tube 11 are defined. The present invention is explained for a case where the electron beam is deflected to a first quandrant of X-Y plane of the picture tube 11.

Figure 3:
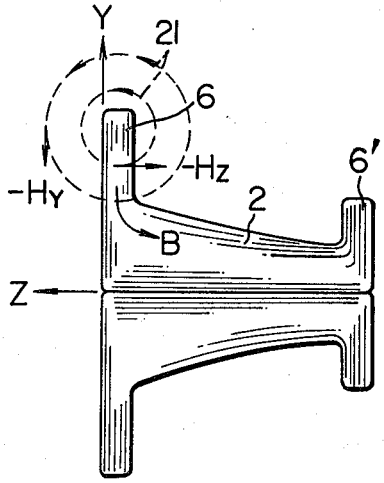
FIG. 3 is a side elevational view of one embodiment of a horizontal deflection coil of the present invention.
Figure 4:
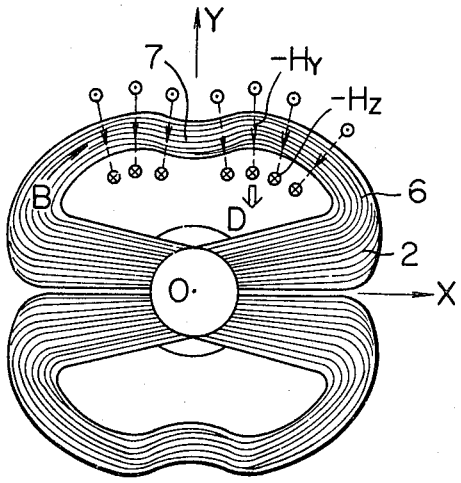
FIG. 4 is a front view thereof.

When a current flows in the horizontal deflection coil 2 as shown by an arrow B in FIG. 3, a current flowing in the fringe 6 on the side of the face plate produces a magnetic field 21 which has a minus Z-direction field component $-H_z$ in an area in the fringe 6 and a minus Y-direction field component $-H_y$ in an area in front of the fringe 6. Since the center portion 7 of the fringe 6 is concave, the magnetic field 21 having the field component $-H_z$ is produced closer to the center axis O, as shown in FIG. 4, than the magnetic field produced by the conventional circular fringe so that the magnetic field is enhanced at the electron beam passing area. Since the electron beam deflected in the first quandrant has the Z-axis component as well as the plus X velocity component, the electron beam is effected by a force in the direction shown by an arrow D, by the field component $-H_z$. Although the electron beam is also effected by such a force in the conventional deflection coil, the force in the present invention is intensified because the horizontal deflection coil 2 of the present invention has the enhanced field component $-H_z$. Since the electron beam is effected by the force in the direction of the arrow D, the raster 12 shown in FIG. 2 is moved in the direction of the arrow $A_1$.

In the horizontal deflection coil 2 of the present invention, the magnetic field produced in front of the fringe 6 also serves to move the raster 12 in the directions $A_1$, $A_2$, $A_3$ and $A_4$. In the conventional horizontal deflection coil, since the fringe thereof is circular, the magnetic field produced in front of the fringe by the current flowing in the fringe is of pincushion shape and has the minus X-direction field component $-H_x$ in the first quandrant. Accordingly, the electron beam having the plus Z-direction velocity component is effected by the Y-direction force by the $-H_x$ field component so that the raster 12 shown in FIG. 2 is deflected in the Y-axis direction. On the other hand, in the horizontal deflection coil 2 of the present invention, since the magnetic field produced in front of the fringe 6 by the current flowing in the fringe 6 is somewhat of barrel shape, the field component $-H_x$ is smaller than that in the conventional horizontal deflection yoke and hence the electron beam is less effected by the Y-direction force. Accordingly, the raster 12 is moved in the direction of $A_1$.

The same is equally applicable to the other quadrants than the first quadrant and the raster 12 is moved in the directions of $A_1$, $A_2$, $A_3$ and $A_4$, respectively. As a result, the distortion of the raster 12 is reduced.

Figure 5:
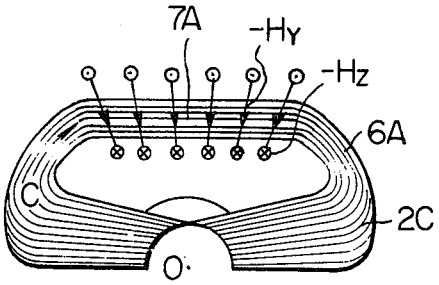
FIG. 5 shows a front view of a horizontal deflection coil half in accordance with a second embodiment of the present invention.

FIG. 5 shows a second embodiment of the horizontal deflection coil of the deflection yoke of the present invention. A horizontal deflection coil 2C has a fringe 6A having its center portion 7A shaped to be linear. In the horizontal deflection coil 2C, when a current shown by an arrow C flows in the fringe 6A, the center portion 7A of the fringe 6A can produce, at the electron beam passing area, a magnetic field having a stronger field component $-H_z$ than the conventional circular fringe. Although the effect of the magnetic field produced by the center portion 7A of the fringe 6A is smaller than the effect in the first embodiment, the horizontal deflection coil 2C of the present embodiment can be used when the distortion of the raster 12 shown in FIG. 2 is small.

Figure 6:
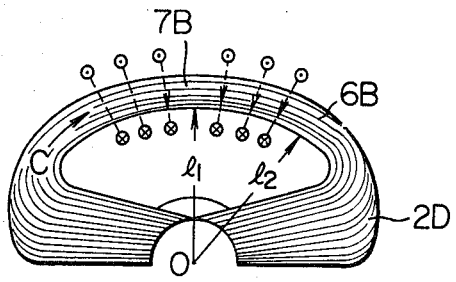
FIG. 6 is a front view of a horizontal deflection coil half in accordance with a third embodiment of the present invention.

FIG. 6 shows a third embodiment of the horizontal deflection coil of the deflection yoke of the present invention. A horizontal deflection coil 2D is generally oval in its entire shape, and a distance $l_1$ between a center portion 7B of a fringe 6B and the center axis O is shorter than a distance $l_2$ in other area. In the horizontal deflection coil 2D, when a current as shown by an arrow C flows in the fringe 6B, the center portion 7B of the fringe 6B can produce, at the electron beam passing area, a magnetic field having a stronger field component $-H_z$ than the conventional circular fringe. The effect of the magnetic field produced by the center porton 7B of the fringe 6B is smaller than that in the second embodiment, but the horizontal deflection coil 2D can be used when the distortion of the raster 12 in FIG. 2 is small.

As described hereinabove, when the deflection yoke of the present invention is used, no vertical raster distortion is produced. Consequently, the present deflection yoke is suitable for use with a 110° wide deflection angle television receiver set. The television receiver circuit does no longer require a pincushion distortion compensation circuit or a secondary harmonics distortion compensation circuit. Furthermore, since only the shape of the horizontal deflection coil is changed, the present deflection yoke is not expensive.

What we claim is:

1. In a deflection yoke for use with a picture tube of a television receiver set comprising a cylindrical core, a vertical deflection coil toroidally wound around said core, and a pair of saddle-type horizontal deflection coils disposed to extend through said core, each of said horizontal coils having a winding width for producing a pincushion shaped deflection field at a front side of the yoke near a face plate of said picture tube due to passage of current through the horizontal coils so that a vertical pincushion distortion on the face plate is reduced and arched front and rear fringes on the front side near the face of said picture tube and on a rear side far from the face plate, respectively, the improvement wherein the front fringe on the front side of each of said horizontal deflection coils is so shaped that a center portion of said front fringe is so deformed that a distance between the center portion of said front fringe and a center axis of said deflection yoke is shorter than distance between any portion other than said center portion of the front fringe and said center axis, whereby a secondary harmonic distortion of the vertical pincushion distortion is reduced.

2. The deflection yoke for use with a picture tube of a television receiver set according to claim 1, wherein the inner surface of said front fringe of said horizontal deflection coil is oval in shape.

3. The deflection yoke for use with a picture tube of a television receiver set according to claim 1, wherein a center portion of the inner surface of the front fringe of said horizontal deflection coil is linear.

4. A deflection yoke for use with a picture tube of a television receiver set according to claim 1, wherein a center portion of the inner surface of the front fringe of said horizontal deflection coil is concaved toward the center axis of said yoke.

5. A deflection yoke for use with a picture tube of a television receiver set acording to claim 1, wherein a center portion of the outer surface of the fringe of said horizontal deflection coil is concave.

6. In a deflection yoke for use with a picture tube of a television receiver including a pair of saddle-type horizontal deflection coils oppositely disposed to one another about a center axis of said yoke, each of said horizontal deflection coils having arched front and rear fringes on a front side near a face plate of said picture tube and on a rear side far from the fact plate, respectively, and said horizontal deflection coils producing a pincushion shaped deflection field at a front side of said yoke near a face plate of said picture tube due to current flowing through said horizontal deflection coils to thereby reduce a vertical pincushion distortion, the improvement wherein the front fringe on the front side of each of said horizontal deflection coils is so shaped that a center portion of said front fringe between extreme portions of said front fringe is concaved in radial direction towards center axis of said yoke from an arched circular position with the same radial distance of the extreme portions of said deflection yoke from the center axis so that the radial distance from the center axis of the center portion of said front fringe is less than that of the extreme portions of said front fringe whereby a secondary harmonic distortion of the vertical pincushion distortion is reduced.

7. The improved deflection yoke according to claim 5, wherein the center portion of each of said horizontal deflection coils is linear.

8. The improved deflection yoke according to claim 6, wherein an outer periphery of the center portion of each of said horizontal deflection coils is formed to be radially concaved.

9. In a deflection yoke for use with a picture tube of a television receiver set comprising a cylindrical core, a vertical deflection coil means around said core, and horizontal deflection coil means disposed to extend through said core, said horizontal deflection coil means including fringe means on one side near the face plate of said picture tube, said fringe means being formed to be concaved in the center portion from other portions of said fringe means so as to generate a compensating magnetic field for reducing a secondary harmonic distortion of the vertical pincushion distortion.

10. The deflection yoke according to claim 9, wherein said fringe means has an inner surface, a distance from a center axis of the deflection yoke to the center portion of the inner surface being less than the distance from the center axis to other portions of the inner surface of said fringe means.

11. The deflection yoke according to claim 9, wherein said fringe means has an inner surface which is oval in shape.

12. A deflection yoke according to claim 9, wherein said fringe means has an inner surface with a center portion which is linear.

13. A deflection yoke according to claim 9, wherein said fringe means has an outer surface with a center portion which is concave.

14. A deflection yoke according to claim 10, wherein said horizontal deflection coil means includes a pair of saddle-type horizontal deflection coils, the center portion of each coil being concave.

* * * * *